US008238786B2

(12) United States Patent
Yamaguchi et al.

(10) Patent No.: US 8,238,786 B2
(45) Date of Patent: Aug. 7, 2012

(54) ELECTROPHOTOGRAPHIC IMAGE FORMING APPARATUS WITH OPENINGS FOR CARTRIDGE INSERTION AND REMOVAL

(75) Inventors: Noritomo Yamaguchi, Suntou-gun (JP); Takao Nada, Numazu (JP); Tomoya Tateishi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 417 days.

(21) Appl. No.: 12/568,046

(22) Filed: Sep. 28, 2009

(65) Prior Publication Data

US 2010/0080614 A1 Apr. 1, 2010

(30) Foreign Application Priority Data

Sep. 29, 2008 (JP) ..... 2008-249592
Sep. 15, 2009 (JP) ..... 2009-212997

(51) Int. Cl.
*G03G 21/18* (2006.01)

(52) U.S. Cl. ..... 399/111

(58) Field of Classification Search ..... 399/107, 399/110–114, 124, 125
See application file for complete search history.

(56) References Cited

U.S. PATENT DOCUMENTS

| | | | | |
|---|---|---|---|---|
| 7,246,963 | B2 * | 7/2007 | Nishimura | 400/692 |
| 7,706,720 | B2 | 4/2010 | Okamoto | |
| 2006/0067734 | A1 | 3/2006 | Igarashi et al. | 399/119 |
| 2009/0047038 | A1 * | 2/2009 | Kobayashi | 399/114 |

FOREIGN PATENT DOCUMENTS

| | | |
|---|---|---|
| JP | 04-157477 | 5/1992 |
| JP | 04-296885 | 10/1992 |
| JP | 07-306572 | 11/1995 |
| JP | 11-133834 | 5/1999 |
| JP | 2001-331079 | 11/2001 |
| JP | 2003-005611 | 1/2003 |
| JP | 2003-177649 | 6/2003 |
| JP | 2005-099292 | 4/2005 |
| JP | 2006-259148 | 9/2006 |

OTHER PUBLICATIONS

Excerpt translation of Office Action in Japanese Patent Application No. 2010-010685, dated Jun. 29, 2010.
Excerpt translation of Office Action in Japanese Patent Application No. 2009-212997, dated Mar. 23, 2010.
Excerpt translation of Office Action in Japanese Patent Application No. 2010-010685, dated Mar. 23, 2010.
Excerpt translation of Office Action in Japanese Patent Application No. 2009-212997, dated Nov. 24, 2009.

* cited by examiner

*Primary Examiner* — Walter L Lindsay, Jr.
*Assistant Examiner* — Ruth Labombard
(74) *Attorney, Agent, or Firm* — Fitzpatrick, Cella, Harper & Scinto

(57) ABSTRACT

An electrophotographic image forming apparatus includes a cartridge supporting member movable between an inside position in the main assembly of the apparatus and an outside position outside the main assembly. The apparatus further includes a first opening through which the cartridge supporting member passes between the inside position and the outside position and a first openable member for openably closing the first opening. A second opening is provided continuing from the first opening and provided above the first opening, with the second opening being effective to permit the cartridge to be removed from the cartridge supporting member in the state that the cartridge supporting member takes the outside position and being effective to permit the supporting member to support the cartridge. The apparatus also includes a second openable member for openably closing the second opening.

6 Claims, 7 Drawing Sheets

ELECTROPHOTOGRAPHIC IMAGE FORMING APPARATUS WITH OPENINGS FOR CARTRIDGE INSERTION AND REMOVAL

FIELD OF THE INVENTION AND RELATED ART

The present invention relates to an electrophotographic image forming apparatus which forms an image on recording medium while keeping image formation cartridges removably mounted in its main assembly.

Here, an "electrophotographic image forming apparatus" means an apparatus which forms a color image on recording medium with the use of an electrophotographic image forming process. Examples of an electrophotographic color image forming apparatus include an electrophotographic color copying machine, an electrophotographic color printer (color laser beam printer, color LED printer, etc.), a color facsimile apparatus, a color wordprocessor, etc. "Recording medium" means medium, such as a sheet of paper, an OHP sheet, etc., on which an image can be formed by an electrophotographic image forming apparatus.

A "cartridge" means a process cartridge or a development cartridge, which contributes to the process of forming an image on recording medium by being removably mounted in the main assembly of an electrophotographic image forming apparatus. The abovementioned process cartridge is a cartridge in which an electrophotographic photosensitive drum, and one or more processing means for processing the photosensitive drum, are integrally disposed, and which is removably mountable in the main assembly of an electrophotographic image forming apparatus. The processing means are such means as a charging means, a developing means, and a cleaning means that are for processing the photosensitive drum. Thus, a "process cartridge" includes a cartridge in which a developing means (processing means), and an electrophotographic photosensitive drum, are integrally disposed, and which is removably mountable in the main assembly of an electrophotographic image forming apparatus. It also includes a cartridge in which a charging means (processing means), a developing means (processing means) or a cleaning means (processing means), and an electrophotographic photosensitive drum, are integrally disposed, and which is removably mountable in the abovementioned main assembly. Incidentally, a process cartridge in which an electrophotographic photosensitive drum and a developing means are integrally disposed is referred to as a process cartridge of the so-called integration type, whereas a process cartridge in which an electrophotographic photosensitive drum, and processing means other than a developing means, are integrally disposed, is referred to as a process cartridge of the so-called separation type.

A process cartridge can be mounted into, or removed from, the main assembly of an electrophotographic image forming apparatus by a user himself or herself. Therefore, the employment of a process cartridge makes it easier to maintain an electrophotographic image forming apparatus. By the way, the processing means are means which process an electrophotographic photosensitive drum.

A development cartridge is a cartridge in which a development roller is disposed. It also holds developer (toner) used by the development roller to develop an electrostatic latent image formed on an electrophotographic photosensitive drum. It is removably mounted in the main assembly of an electrophotographic image forming apparatus. In the case of an electrophotographic image forming apparatus which uses a development cartridge, its electrophotographic photosensitive drum is attached to the main assembly of the image forming apparatus, or the cartridge supporting member of the apparatus, which will be described later, or it is disposed in a process cartridge (which does not have developing means) of the so-called separation type. A development cartridge also can be mounted into, or removed from, the main assembly of an image forming apparatus by a user himself or herself, and therefore, can make it easier to maintain the main assembly.

Thus, process cartridges to which the present invention is applicable include the process cartridges of the so-called integration type, as well as the process cartridges of the so-called separation type. Further, the electrophotographic image forming apparatuses to which the present invention is applicable include electrophotographic image forming apparatuses which employ in pair a process cartridge of the so-called separation and a development cartridge. Moreover, they also include such development cartridges that are removably mountable in an electrophotographic image forming apparatus, the electrophotographic photosensitive member of which is unremovably attached to the main assembly of the apparatus, or the cartridge supporting member of the apparatus, which will be described later.

As the structural arrangement for mounting a cartridge (for example, process cartridge) in the main assembly of an electrophotographic image forming apparatus, or removing the cartridge from the main assembly, the following structural arrangement has been known. An electrophotographic image forming apparatus and the process cartridge therefor are structured so that the cartridges can be removably mounted in the tray of the main assembly of the apparatus, which can be pulled out of the main assembly (US2006/0067734). There has also been known an image forming apparatus, the top portion of which is provided with a lip which can be upwardly opened (Japanese Laid-open Patent Application H04-296885).

It is reasonable to think that in order to replace the process cartridge, which is at the rearmost end of the cartridge tray of a conventionally structured electrophotographic image forming apparatus, it is necessary to pull virtually entire cartridge tray out of the main assembly of the image forming apparatus. Therefore, the space for setting up a conventionally structured electrophotographic image forming apparatus has to be large enough to provide the space for allowing the cartridge tray to be pulled out frontward of the main assembly of the apparatus.

Some image forming apparatuses having a top lid which is to be upwardly opened are structured so that the top lid is opened by the force from a motor.

The present invention was made in consideration of the above-described concerns.

SUMMARY OF THE INVENTION

The primary object of the present invention is to provide an electrophotographic image forming apparatus which is significantly smaller in the operational space it requires, and also, is significantly easier in terms of the operation for mounting or dismounting cartridges than a conventionally structured electrophotographic image forming apparatus.

Another object of the present invention is to provide an electrophotographic image forming apparatus which is significantly smaller in the operational space it requires, and also, is significantly easier in terms of the operation for removing the recording medium which has stuck in the main assembly of the apparatus.

Another object of the present invention is to provide an electrophotographic image forming apparatus, the doors of which can be opened or closed by the movement of the cartridge supporting member of the apparatus.

Another object of the present invention is to provide an electrophotographic image forming apparatus structured so that the recording medium which has stuck in its recording medium conveyance passage which is behind the innermost position the cartridge supporting member can be easily removed.

Another object of the present invention is to provide an electrophotographic image forming apparatus structured so that the recording medium has stuck in the recording medium conveyance passage which is below the innermost position of the cartridge supporting member can be easily removed.

According to an aspect of the present invention, there is provided an electrophotographic image forming apparatus for forming an image on a recording material in the state that cartridge is detachably mounted to a main assembly of said electrophotographic image forming apparatus, said electrophotographic image forming apparatus comprising a cartridge supporting member movable between an inside position in said main assembly of the apparatus and an outside position outside said main assembly of the apparatus when a cartridge is mountable thereto and dismountable from said cartridge supporting member; a first opening through which said cartridge supporting member passes between the inside position and the outside position; a first openable member for openably closing said first opening; a second opening continuing from said first opening and provided above said first opening, said second opening being effective to permit the cartridge to be removed from said cartridge supporting member in the state that cartridge supporting member takes the outside position and being effective to permit said cartridge supporting member to support said cartridge; a second openable member for openably closing said second opening, said second openable member being effective to prevent external light from entering said main assembly of the apparatus when said second openable member closes said second opening; and an interrelating means for moving said second openable member to the opening position in interrelation with movement of said cartridge supporting member from the inside position to the outside position.

The present invention can make it easier to mount a cartridge into an electrophotographic image forming apparatus, or remove a cartridge from the apparatus, while reducing the space necessary for the operation of the main assembly of the electrophotographic image forming apparatus.

The present invention can make it easier to remove the recording medium which has stuck in an electrophotographic image forming apparatus, while reducing the space necessary for the operation of the main assembly of the image forming apparatus.

The present invention can make it possible for the movable covers (door, lid, etc.) of an electrophotographic image forming apparatus to be opened or closed by the movement of the cartridge supporting member of the apparatus.

The present invention can make it easier to remove the recording medium having stuck in the recording medium conveyance passage which is on the rear side of the innermost position for the cartridge supporting member.

The present invention can make it easier to remove the recording medium having stuck in the recording medium conveyance passage which is on the under side of the innermost position for the cartridge supporting member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Figure 1:
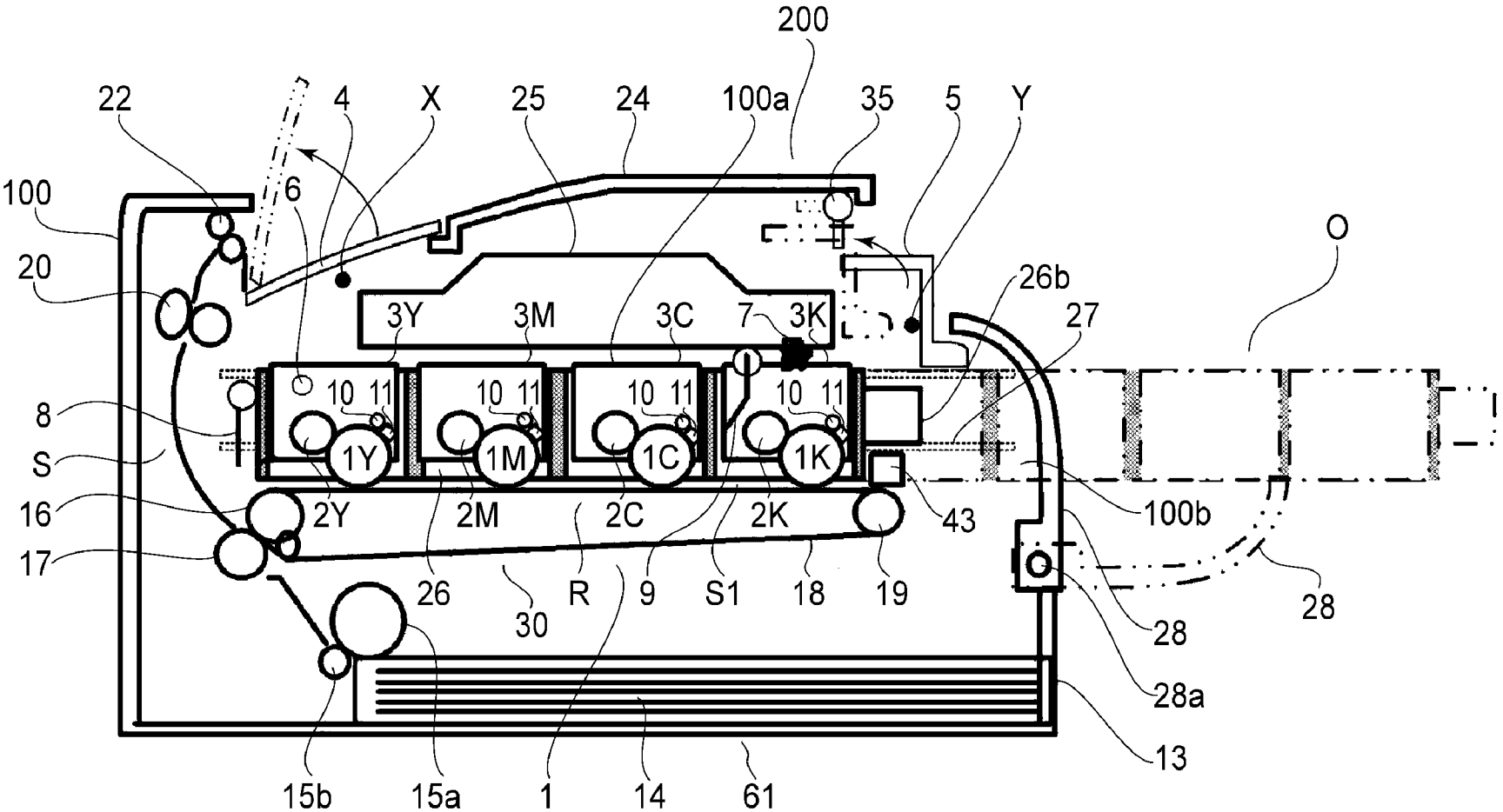
FIG. 1 is a drawing for describing the image forming apparatus in the first preferred embodiment of the present invention.

Hereinafter, the image forming apparatuses in the preferred embodiments of the present invention will be concretely described with reference to the appended drawings.

Embodiment 1

Overall Structure of Image Forming Apparatus

First, referring to FIGS. 1 and 2, the overall structure of the electrophotographic image forming apparatus in the first preferred embodiment of the present invention will be described.

The image forming apparatus 200 in this embodiment of the present invention is a full-color laser printer, which uses an electrophotographic image formation process and four primary colors. The image forming apparatus 200 forms an image on a sheet 14 (recording medium), in response to the image formation signals inputted from an external host apparatus (unshown), for example, a personal computer, an image reader, or the like. Here, recording medium means any medium, for example, paper, OHP sheet, label, etc., on which an image can be formed with the use of an electrophotographic image formation process.

In the following descriptions of the preferred embodiments of the present invention, the front side of the image forming apparatus 200 means the side where a door 28 (member which can be opened or closed) is present, and the rear side of the image forming apparatus means the side opposite from the front side. Further, the left or right side of the image forming apparatus means the left or right side when the main assembly 100 is seen from the front side. Further, the rear side is the upstream side in terms of the direction 300 (indicated by arrow mark in FIG. 2) in which a tray 26 (cartridge supporting member), which will be described later, is moved from its innermost position I to its outermost position O. The front side is the downstream side in terms of the direction 300.

Figure 2:
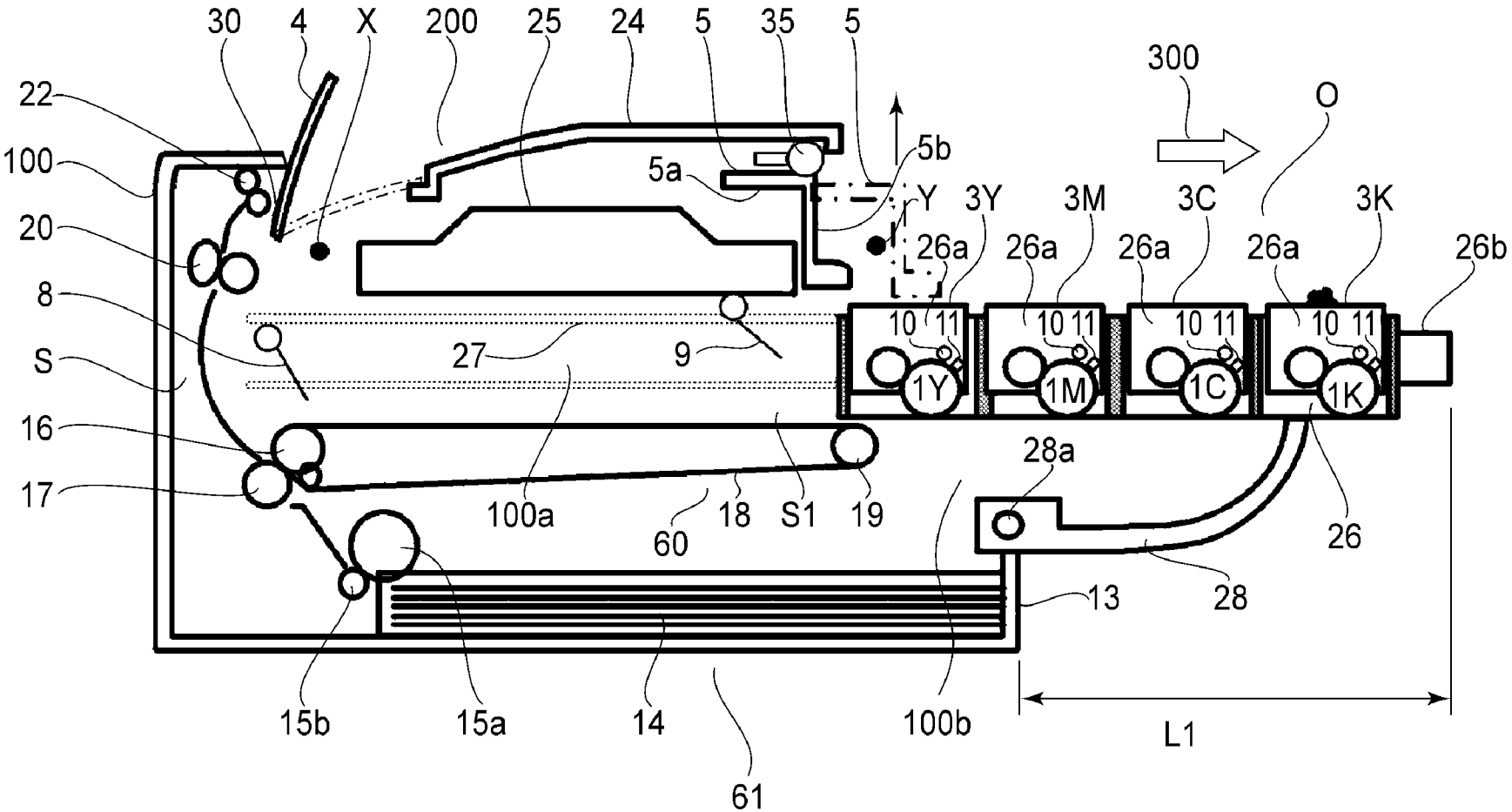
FIG. 2 is a drawing for describing the operation for replacing the cartridges in the image forming apparatus in the first preferred embodiment.

Referring to FIG. 2, the main assembly 100 (which hereafter may be referred to as apparatus main assembly) of the image forming apparatus contains four process cartridges 3 (which hereafter will be referred to simply as "cartridge 3"), more specifically, first to fourth cartridges 3 (3Y, 3M, 3C, and 3K) (listing from rear), respectively, which were horizontally mounted in parallel in the main assembly 100. The four cartridges 3 are the same in structure, although they are different from each other in the color of the developer (toner) they contain.

Each of the cartridges 3 in this embodiment is made up of a rotatable photosensitive drum 1 (1Y, 1M, 1C, or 1K), three processing means for processing the photosensitive drum 1, and a cartridge frame. More specifically, three processing means are a charging member 10, a developing device having a development roller 2 (2Y, 2M, 2C, or 2K), etc., and a cleaning device 11. The photosensitive drum 1 and the three processing means are integrally attached to the inward side of the cartridge frame 5. The charging device 10 is in the form of a roller, and charges the photosensitive drum 1. The cleaning device 11 is in the form of a blade, and removes the toner remaining on the photosensitive drum 1 after transfer. After being charged by the charging device 10, the photosensitive drum 1 is irradiated with a beam of laser light, which will be described later. As a result, an electrostatic latent image is formed on the photosensitive drum 1. The electrostatic latent image is developed by the development roller 2, which uses toner (developer). Consequently, a visible image (which hereafter will be referred to as toner image or developer image) is formed of toner (developer), on the photosensitive drum 1.

The first cartridge 3Y contains yellow toner in its developing device (developer storage), and forms a yellow toner image on its photosensitive drum 1. The second cartridge 3M contains magenta (M) toner, and forms a magenta toner image on its photosensitive drum 1. The third cartridge 3C contains cyan toner in its developing device, and forms a cyan toner image on its photosensitive drum 1. The fourth cartridge 3K contains black toner, and forms a black toner image on its photosensitive drum 1.

The main assembly 100 is provided with a laser scanner unit 25, which is above the cartridges 3Y, 3M, 3C, and 3K. The unit 25 scans (exposes) the peripheral surface of the photosensitive drum 1 of each cartridge 3, by outputting a beam of laser light while modulating the beam of laser light with the information regarding each of the monochromatic images, which is inputted from the external host apparatus (unshown).

The main assembly 100 is also provided with an intermediary transfer belt unit 60, which is below the cartridges 3Y, 3M, 3C, and 3K. The belt unit 60 has an endless belt 18 (intermediary transfer member), a driver roller 16, and a tension roller 19. The endless belt 18 is formed of a dielectric material, and is flexible. The driver roller 16 circularly drives the belt 18.

The photosensitive drum 1, which each cartridge 3 has, is in contact with the belt 18 by the bottom portion of the peripheral surface of the drum 1. The main assembly 100 is provided with four primary transfer rollers (unshown), which are disposed within the loop which the transfer belt 18 forms. Further, the main assembly 100 is provided with a secondary transfer roller 17, which is kept pressed against the roller 16, with the presence of the belt 18 between the two rollers 17 and 16.

The main assembly 100 is provided with a recording medium feeder unit 61, which is in the bottom portion of the main assembly 100. The recording medium feeder unit 61 has a feeder tray 13, a feeder roller 15*a*, a separation roller 15*b*, etc. The tray 13 is removably mountable in the main assembly 100 from the front side of the main assembly 100 (front loading).

Further, the main assembly 100 is provided with a fixing apparatus 20 and a pair of discharge rollers 22, which are in the top rear portion of the main assembly 100. A part of the top wall of the main assembly 100 is in the form of a delivery tray 24.

In an image forming operation, four monochromatic toner images, different in color, are formed on the four photosensitive drums 1, one for one, with the use of an electrophotographic image formation process. Then, the four toner images are sequentially transferred (primary transfer) onto the rotating belt 18. As a result, a full-color image is effected on the belt 18. In synchronism with the progression of this image forming operation, a sheet 14 (of recording medium) is conveyed into the secondary transfer portion, which is the nip between the secondary transfer roller 17 and belt 18, while a bias is applied to the transfer roller 17. As a result, the toner images on the belt 18 are transferred together onto the sheet 14 by the bias.

After the transfer of the toner images onto the sheet 14, the sheet 14 is conveyed to the fixing apparatus 20, in which the sheet 14 is subjected to heat and pressure to fix the toner images to the sheet 14. After the fixation of the toner images, the sheet 14 is discharged into the delivery tray 24 by the pair of discharge rollers 22.

(Structural Arrangement for Mounting or Dismounting Cartridge)

Next, the structural arrangement for mounting the cartridges 3 into the main assembly 100, or dismounting the cartridges 3 from the main assembly 100, will be described.

Referring to FIGS. 1 and 2, the front panel of the main assembly 100 is provided with a hole 100*b* (first hole of the main assembly 100). The front panel is provided with a door 28 (which can be opened or closed), which is attached to the front panel so that it can be rotationally moved about a shaft 28*a* attached to the bottom portion of the door 28 so that the door 28 can be opened to expose the hole 100*b*, or closed to cover the hole 100*b*. The door 28 is attached to the front panel so that it can be rotationally moved to expose or cover the hole 100*b*. The hole 100*b* is the hole which the tray 26 passes when it is moved between its innermost position I and outermost position O. The door 28 is rotationally moved outward of the main assembly 100 about the shaft 28*a* attached to the bottom of the door 28 to expose or cover the hole 100*b*.

The main assembly 100 is provided with a cartridge space 100*a* in which the cartridges 3 are mounted. The cartridge space 100*a* is in the main assembly 100. The main assembly 100 is also provided with a cartridge tray 26 (cartridge supporting member) which supports the cartridges 3. The cartridge tray 26 is attached to the inward side of the cartridge space 100*a*. More specifically, the cartridge tray 26 is attached to the main assembly frame in such a manner that it is slidingly movable in the frontward or backward direction while being guided by a pair of rails 27L and 27R on the left and right internal walls, respectively, of the main assembly frame, which form the cartridge space 100*a*. Thus, the cartridge tray 26 is linearly movable between its innermost position I (relative to main assembly 100) and outermost position O (relative to main assembly 100) while holding the cartridges 3.

The outermost position O is the position (outlined by dotted line in FIG. 1; position shown in FIG. 2), which allows a user to mount the cartridge 3 into the tray 26, or remove the cartridge 3 from the tray 26 (replace cartridges 3). That is, it is when the tray 26 is in its outermost position O that a user places the cartridges 3 in the tray 26 so that the cartridges 3 are supported by the tray 26, or that a user removes the cartridge 3. It is after the cartridge tray 26 is pulled out from its innermost position I (outlined by solid line in FIG. 1) to its outermost position O when a user is to mount the cartridge 3 into the tray 26, or to remove the cartridge 3 from the tray 26. Then, as the user pushes the tray 26 into its innermost position I, the cartridges 3 are placed in their image forming positions R (FIG. 1).

The image forming position R is the position in which each cartridge 3 contributes to image formation. In this embodiment, the image forming position R is the position in which the drum 1 in the cartridge 3 is in contact with the belt 18. Incidentally, when the cartridge 3 is in its image forming position R, the cartridge 3 does not need to remain supported by the tray 26; the cartridge 3 may be floating from the tray 26.

As a user pushes the tray 26 into the main assembly 100, the cartridges 3 supported by (mounted into) the tray 26 in the outermost position O are moved into the innermost position I, and the cartridges 3 are accurately positioned in their image forming positions R. In this embodiment, as the door 28 is closed while the tray 26 is in its innermost position I, the tray 26 lowers, positioning thereby the cartridges 3 in their image forming positions R. On the other hand, as the door 28 is opened, the tray 26 moves upward, and the cartridge 3 move upward with the tray 26. As a result, the photosensitive drum 1 separates from the transfer belt 18.

In the embodiment described above, the tray 26 horizontally moves relative to the surface (unshown) on which the main assembly 100 is placed. However, the direction in which the tray 26 is moved does not need to be limited to this direction. For example, it may be diagonally upward or downward in a straight line relative to the surface (unshown) which is supporting the main assembly 100. That is, the tray 26 linearly moves in the direction perpendicular to the lengthwise direction of the cartridges 3 which the tray 26 supports. The lengthwise direction of the cartridge 3 is the direction parallel to the lengthwise direction of the photosensitive drum 1 or development roller 2.

The tray 26 is provided with multiple cartridge supporting portions 26*a* (FIG. 2) which removably supports the multiple cartridges 3 (3Y, 3M, 3C, and 3K), one for one; one cartridge 3 fits in each supporting portion 26*a*. That is, four cartridges 3Y, 3M, 3C, and 3K are removably supported by (mounted in) the tray 26. Referring to FIG. 2, the tray 26 is provided with a handle 26*b*, which is at the front end of the tray 26. A user is to pull out the tray 26 from the main assembly 100, or to push the tray 26 into the main assembly 100, by grasping the handle 26*b*.

The procedure for mounting or dismounting the cartridges 3 (3Y, 3M, 3C, and 3K) is as follows. First, a user is to open the door 28, and then, to grasp the handle 26*b*. As the handle 26*b* is grasped, a locking member 46, which keeps the tray 26 locked to the main assembly 100, is slid, being thereby made to release the tray 26. Then, the user is to pull the tray 26 to a preset position (outermost position O), which is on the front side, by grasping the handle 26*b*. As a result, the cartridges 3 supported by the tray 26 are exposed from the main assembly 100, allowing thereby the cartridges 3 to be removed upward. In other words, the cartridges 3 in the tray 26 can be easily replaced. That is, the tray 26 supports the cartridges 3, so that the cartridges 3 can be slidingly moved relative to the main assembly 100, making it easier to mount multiple cartridges 3 into the main assembly 100, or remove them from the main assembly 100.

Incidentally, how far the tray 26 is pulled out of the main assembly 100 is regulated by the contact between a stopper (unshown), with which the main assembly 100 is provided, and a stopper (unshown), with which the tray 26 is provided. That is, the length by which the tray 26 is allowed to be pulled out of the main assembly 100 is regulated by this setup. Therefore, it does not occur that the tray 26 becomes disengaged from the main assembly 100.

After the tray 26 is pulled out and the cartridges 3 are mounted into the tray 26, the tray 26 is to be slidingly pushed rearward (deeper end) of the apparatus 100 to be moved back into a preset position (innermost position I), until a projection (unshown), with which one end of the tray 26 is provided, comes into contact with a tray positioning portion (unshown) of the main assembly 100. At this point, the user is to release the handle 26*b*. As the user release the handle 26*b*, the locking member 34 slides back into its locking position, locking thereby the tray 26 to the main assembly 100. Then, the user is to close the door 28. As the door 28 is closed, the driving force transmission coupling (unshown) of each of the cartridges 3 engages with the corresponding driving force transmission coupling (unshown) of the main assembly 100, and each cartridge 3 is secured in its image forming position R. By the way, the main assembly 100 is what remains after the tray 26, covers 4 and 5, and door 28 are removed from the image forming apparatus 100.

(Structural Arrangement for Opening or Closing Covers)

The image forming apparatus 200 is provided with two covers, which can be opened or closed relative to the main assembly 100. One is on the front side of the main assembly 100, and the other is on the rear side of the main assembly 100.

More specifically, the front cover 5 (second cover) is at the top front corner of the main assembly 100, and is on the top side of the door 28 (FIG. 1). The cover 5 exposes or covers the cartridge exposing opening Y (second opening), which is for mounting the cartridge 3Y (which is the most upstream cartridge in terms of the direction 300 (FIG. 2) in which the tray 26 is pulled out of the main assembly 100) into the tray 26, or removing the cartridge 3Y from the tray 26, when the tray 26 is the outermost position O. The opening Y is on the top side of the hole 100*b* (door 28), and is in connection to the hole 100*b*. The opening Y is for removing the cartridge 3 supported by the tray 26, from the tray 26, when the tray 26 is in its outermost position O. The opening Y is also for making the tray 26 support the cartridge 3, when the tray 26 is in its outermost position O. That is, the opening Y is the opening through which the cartridge 3 is put through by a user when the user is mounting the cartridge 3 into the tray 26, or dismounting the cartridge 3 from the tray 26.

Another role of the cover 5 is to prevent light from entering the main assembly 100 from outside the main assembly 100 when the cover 5 is in its closed position. That is, when the cover 5 is in its closed position, it prevents the ambient light from hitting the cartridges P in the main assembly 100. The cover 5 is for exposing or covering the opening Y. That is, the cover 5 is for preventing the ambient light from entering the main assembly 100 when it is in its closed position (outlined by solid line in FIG. 1). Thus, the cover 5 is made of a resinous material which does not transmit light.

The rear cover 4 (third door), which is on the rear side of the main assembly 100, is above a sheet passage S (sheet conveying rear passage) (FIG. 1). That is, the cover 4 is a part of the top wall of the main assembly 100. The sheet conveyance passage S is the sheet passage from the secondary transfer roller 17 to the pair of discharge rollers 22. The cover 4 is structured so that it can at least partially expose or cover the bottom portion of the sheet conveyance passage opening X (third opening). A user can insert his or her hand, at least partially, into sheet conveyance passage S through the opening X. The cover 4 makes up a part of the delivery tray 24 when it is in its closed position. That is, as the cover 4 is closed, it is placed where it catches the sheet 14 as the sheet 14 is discharged. The opening X is in the top portion of the main assembly 100. It is for removing the sheet 14 when the sheet 14 becomes stuck in the sheet conveyance passage S, which is positioned so that when the tray 26 is in its innermost position I, the sheet conveyance passage S is on the rear side of the tray 26. That is, the opening X is the opening through which the sheet 14 can be pulled out of the main assembly 100 if the sheet 14 gets stuck in the sheet conveyance passage S. The cover 4 keeps the opening X covered in such a manner that if necessary, the opening X can be exposed. When the cover 4 is in its position (outlined by solid line in FIG. 1) for keeping the opening X closed, it prevents the ambient light from entering the interior of the main assembly 100. That is, the cover 4 prevents the ambient light from hitting the cartridges 3 in the main assembly 100. Thus, the cover 4 is made of a resinous material which does not transmit light.

The front cover 5 is opened by the movement of the tray 26; as the tray 26 is pulled out of the main assembly 100, the front cover 5 is opened by the outward movement of the tray 26, whereas as the tray 26 is pushed into the main assembly 100, the cover 5 is closed by the inward movement of the tray 26.

As for the cover 4, it is only when the sheet 14 is remaining stuck (jammed) in the sheet conveyance passage S that the cover 4 is opened by the movement of the tray 26 as the tray 26 is pulled out of the main assembly 100; normally, the covered 4 is not opened by the movement of the tray 26 even when the tray 26 is pulled out of the main assembly 100.

FIG. 2 is a sectional view of the image forming apparatus 200 when the tray 26 is in its outermost position O to which the tray 26 was pulled out to replace the cartridge(s) 3. As the tray 26 is pulled out of the main assembly 100 and the cover 5 is opened to expose the opening Y, the cartridges 3 in the tray 26 are exposed (FIG. 2). It should be noted here that the cover 5 is automatically opened by the outward movement of the tray 26. Thus, as the tray 26 is pulled out to its outermost position O, all the cartridges 3, including the cartridge 3Y, are exposed from the main assembly 100. In FIG. 2, the position in which the cover 5 is when the opening Y is remaining exposed is outlined by a solid line, and the position in which the cover 5 is when the opening Y is remaining covered is outlined by a dotted line. As the tray 26 is pulled out of the main assembly 100, the cover 5 is slidingly moved both upward and rearward (deeper end of main assembly 100) by the movement of the tray 26 while remaining in the same attitude as it remains when it is in its closed position. The cover 5 slidingly moves between its position (outlined by solid line in FIG. 1) for keeping the opening Y closed, and its open position (outlined by dotted line in FIG. 1) for keeping the opening Y exposed, while remaining the same in attitude. The cover 5 never fails to be moved to its outward position by the movement of the tray 26 when the tray 26 is pulled out of the main assembly 100. That is, as the tray 26 is pulled out of the main assembly 100, the cover 5 always moves into its open position.

More specifically, as the tray 26 is pulled out frontward from the main assembly 100 by a distance of L1 (FIG. 2), the four cartridges 3 are exposed from the main assembly 100. Referring to FIG. 2, the distance L1 is a distance which is just enough to pull three cartridges 3M, 3C, and 3K out of the main assembly 100 in the frontward direction of the main assembly 100. Thus, the cartridge 3Y, which is at the deepest end of the main assembly 100 is exposed from the main assembly 100 by the above described movement of the cover 5 toward the rear end of the main assembly 100. Therefore, a user can take the cartridge 3Y out of the tray 26 simply by pulling the tray 26 out of the main assembly 100 by the distance L1. That is, this embodiment makes it possible to smoothly mount the cartridge 3Y into the tray 26, or dismount the cartridge 3Y from the tray 26, without pulling the tray 26 out of the main assembly 100 far enough to place the cartridge 3Y beyond the hole 100*b*. In the case of this image forming apparatus 200, the cartridge 3Y is supported by the most upstream portion of the tray 26, in terms of the direction 300 (FIG. 2) in which the tray 26 is pulled out of its innermost position I to its outermost position O. Further, in terms of the vertical direction, the hole 100*b* is above the shaft 28*a*. These structural arrangements in this embodiment can reduce the amount of space required to operate the apparatus 200.

Referring to FIG. 2, as the tray 26 is pulled out of the main assembly 100, the movement of the tray 26 causes the rear cover 4 to rotationally open rearward about a rotational shaft 30 which is at the bottom of the rear cover 4. As a result, the top portion of the sheet conveyance passage S in the main assembly 100 becomes exposed, making it easier for a user to remove the jammed sheet 14 in the portion of the sheet conveyance passage S, which is between the secondary transfer portion (secondary transfer roller 17) and the fixing portion (fixing apparatus 20).

The image forming apparatus 200 is not structured so that as the tray 26 is pulled out of the main assembly 100, the cover 4 is always opened by the movement of the tray 26. That is, the image forming apparatus 200 is structured so that it is only when there is a jammed sheet 14 in the sheet conveyance passage S that as the tray 26 is pulled out of the main assembly 100, the cover 4 is opened by the outward movement of the tray 26.

Here, referring to FIGS. 3-8, the means (first and second means) for causing the movement of the tray 26 to open or close the covers 5 and 4 will be described. Shown in the drawings is only one side of the image forming apparatus 200 in terms of the left and right directions of the tray 26. However, the other side of the image forming apparatus 200 is also provided with the means for causing the movement of the tray 26 to open or close the covers 5 and 4, which is similar to the first means.

Figure 3:
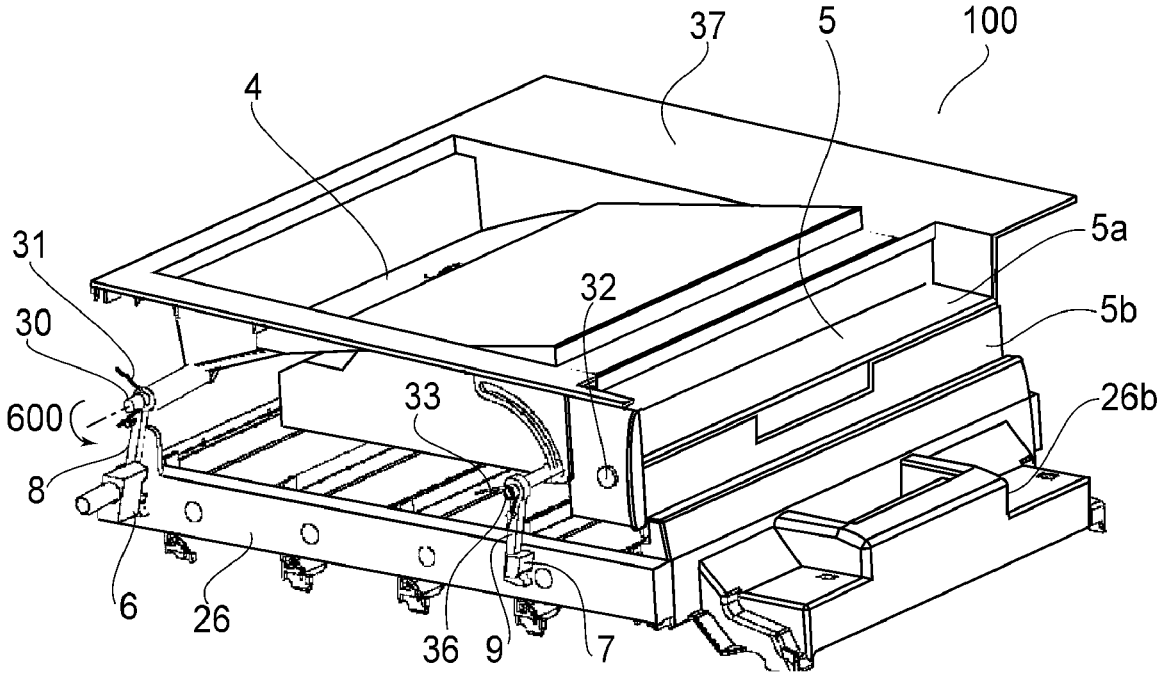
FIG. 3 is a drawing for describing the mechanism for causing the movement of the tray to move the covers, in the first preferred embodiment.

Referring to FIG. 3, the rotational shaft 30 of the cover 4 is in connection with one end of an arm 8. Further, one end of the cover 4 and one end of the arm 8 are solidly attached to the rotational shaft 30. Thus, the rotational shaft 30, cover 4, and arm 8 rotate together. The rotational shaft 30 is fitted with a torsional coil spring 31 (elastic member). One end of the torsional coil spring 31 is attached to a preset portion of the main assembly 100, and the other end is attached to the arm 8. Thus, the arm 8 is under the pressure generated by the resiliency of the spring 31 in the counterclockwise direction 600 (FIG. 3). Therefore, when the tray 26 is in its innermost position I, the arm 8 remains engaged with a projection 6, with which the rear end of the tray 26 is provided.

Figure 4:
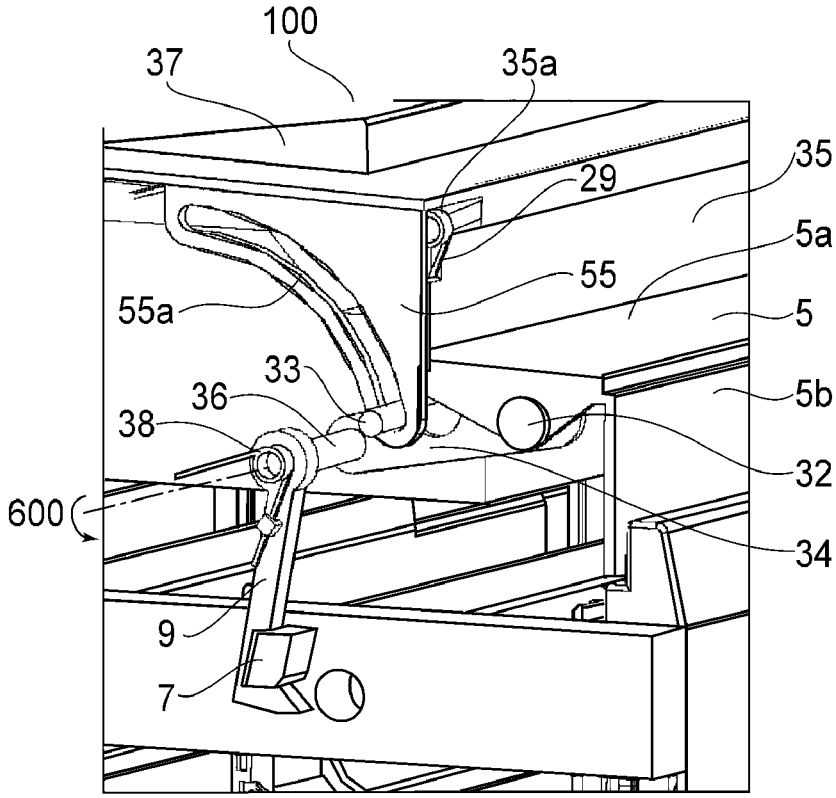
FIG. 4 is a drawing for describing the image forming apparatus in the first preferred embodiment.

Next, referring to FIG. 4, the cover 5 is provided with two shafts 32 and 33. The cover 5 has a horizontal portion 5*a* and a vertical portion 5*b*. The horizontal portion 5*a* prevents the ambient light from entering the main assembly 100 from the top side of the main assembly 100. The vertical portion 5*b* prevents the ambient light from entering the main assembly 100 from diagonally above the main assembly 100. One end of the shaft 32 is fitted in one of the cover linkage 34. The other end of the linkage 34 is attached to a rotational shaft 36 that it can be rotated about the rotational shaft 36. Thus, the rotational shaft 36, an arm 9, and linkage 34 rotate together.

Further, the rotational shaft 36 is fitted with a coil spring 38 (elastic member), one end of which is attached to a predetermined portion of the main assembly 100, and the other end of which is attached to the arm 9. With the provision of this structural arrangement, the arm 9 is kept pressured in the counterclockwise direction 600 (FIG. 4) by the resiliency of the spring 38. Further, when the tray 26 is in its innermost position I, the arm 9 is in connection with a projection 7, with which the front side of the tray 26 is provided.

Further, the main assembly 100 is provided with a guiding plate 55, which is provided with an arcuate guiding groove 55*a*, in which the shaft 33 of the cover 5 is fitted, being enabled to slidingly move in the groove 55*a*.

There is a flapper 35 above the cover 5 (horizontal portion 5*a*). The flapper 35 is attached to the top cover 37 in such a manner that it is rotatable about the shaft 35*a*, which is fitted with a torsional coil spring 29 (elastic member). Thus, the flapper 35 is kept pressed in the counterclockwise direction (FIG. 40) by the resiliency of the coil spring 29. One end of the flapper 35 is in contact with one end of the cover 5. The flapper 35 prevents the ambient light from entering the main assembly 100 through the gap between the top cover 37 and cover 5 (horizontal portion 5*a*).

(Opening and Closing of Covers)

Next, the sliding movement of the tray 26, opening of the cover 4, and opening and closing of the cover 5 will be described.

The image forming apparatus 200 is structured so that if the tray 26 is pulled out when the sheet conveyance passage S is remaining jammed with the sheet 14, the cover 4 is opened by the outward movement of the tray 26. Thus, referring to FIGS. 5 and 8, this structural arrangement will be described. Normally, the cover 4 is not opened by the outward movement of the tray 26; it remains closed. The main assembly 100 is provided with a solenoid 700 having a lever 47. The lever 47 is in connection with the arm 8. There is a sensor 400 positioned along the sheet conveyance passage S.

If a jam occurs, a jam occurrence signal is transmitted from the sensor 400 to a control portion 500, which controls the entirety of the apparatus 200. Receiving the jam occurrence signal, the control portion 500 rotationally moves the lever 47 by driving the solenoid 700. This rotational movement of the lever 47 disengages the lever 47 from the arm 8, allowing thereby the arm 8 to be rotationally moved in the counterclockwise direction by the resiliency of the spring 31. As a result, the arm 8 comes into contact with the projection 6, with which the tray 26 is provided as described before. If a user pulls out the tray 26 when the apparatus 200 is in the above described condition, the arm 8 rotates, opening thereby the cover 4. The opening of the cover 4 exposes the opening X, making it possible to take care of the jam (to remove the jammed sheet).

On the other hand, when there is no jammed sheet in the sheet conveyance passage S, the arm remains engaged with the lever 47 of the solenoid 700. Thus, even if the tray 26 is pulled out of the main assembly 100, the cover 4 does not open; it remains closed.

As soon as the jammed sheet is removed, the driving of the solenoid 700 is stopped, and therefore, the arm 8 comes into contact with the lever 47, preventing thereby the arm 8 from being moved by the movement of the tray 26. The ending of the process of taking care of the jam is detected by a sensor (unshown) which detects the closing of the door 28 or cover 4, for example. This information regarding the ending of the process of taking care of the jam is received by the control portion 500. Then, the control portion 500 stops the driving of the solenoid 700 based on this information.

(Opening Operation)

If it is necessary again to replace the cartridge(s) 3 or to take care of the jamming of the sheet 14, a user has to open the door 28 (FIG. 2), first. Then, the user is to pull the tray 26 out of the main assembly 100 by grasping the handle 26*b*. The outward movement of the tray 26 frees the projection 7, which was preventing the cover 5 from rotationally moving. Consequently, the arm 9 is rotated about the shaft 36 by the resiliency of the spring 38, causing thereby the cover 5 to open. That is, this embodiment of the present invention makes it possible for the opening Y to be exposed by the outward movement of the tray 26. The area outlined by a dotted line in FIG. 2 is where the cover 5 is when it is open.

Figure 5:
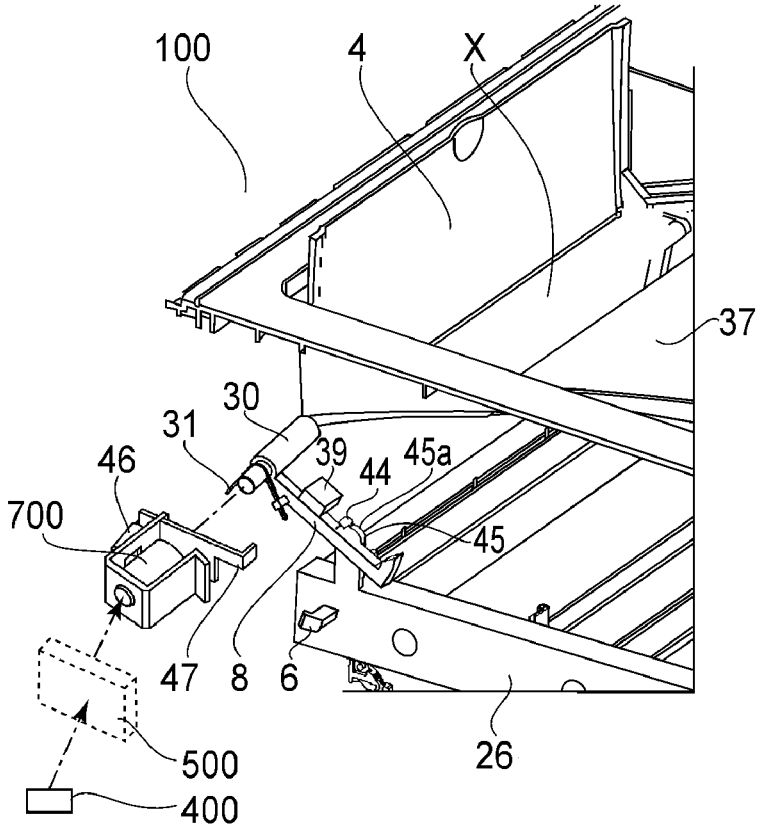
FIG. 5 is a drawing for describing the mechanism for causing the movement of the tray to move the covers, in the first preferred embodiment.

FIG. 5 is a perspective view of the cover 4 when the cover 4 is open. If the sheet conveyance passage S is jammed with the sheet 14 while the tray 26 is in the position which keeps the cartridges 3 in their image forming positions R, the arm 8 is disengaged from the lever 47 by the above described operation. Then, the disengaged arm 8 comes into contact with the projection 6. Therefore, as the tray 26 is pulled out of the main assembly 100, the arm 8 is rotationally moved by the resiliency of the spring 31 until it is stopped by its contact with an arm stopper 39, with which the top cover 37 (FIG. 3) is provided. Consequently, the cover 4 is kept open by the resiliency of the spring 31. As the cover 4 is opened, the opening X becomes exposed.

The exposure of the opening X exposes the top portion of the sheet conveyance passage S, making it possible for a user to access the sheet conveyance passage S from the front side of the main assembly 100. Therefore, the user can easily remove the jammed sheet 14 in the sheet conveyance passage S.

Figure 6:
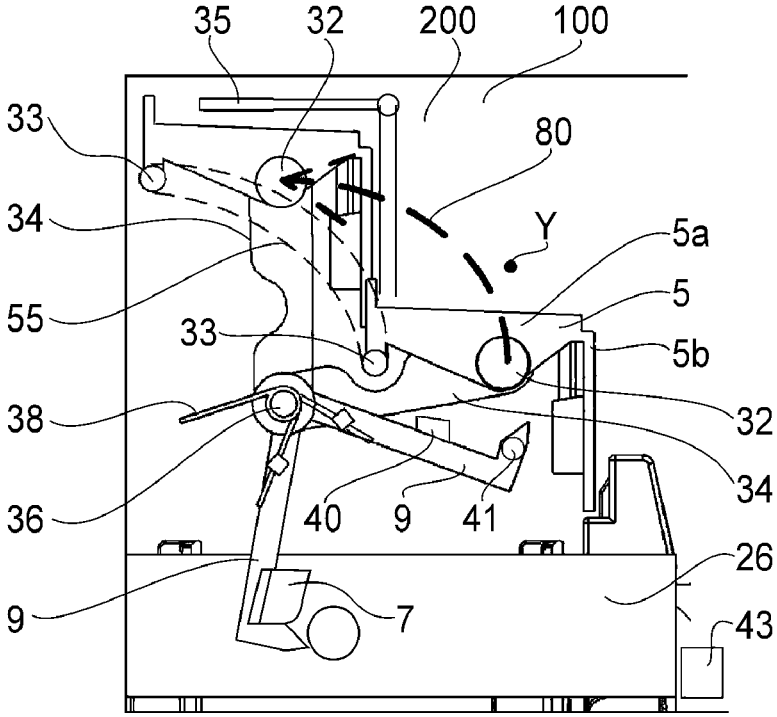
FIG. 6 is a drawing for describing the mechanism for causing the movement of the tray to move the covers, in the first preferred embodiment.

FIG. 6 is a sectional view of the portion of the apparatus 200, which concerns this embodiment of the present invention, when the cover 5 is open. As the tray 26 is pulled out of the main assembly 100, the outward movement of the tray 26 causes the arm 9 to disengage from the projection 7. Consequently, the arm 9 is rotationally moved in the counterclockwise direction by being pressed by the resiliency of the spring 38, until it comes into contact with an arm catcher 40 on the main assembly 100, which stops the rotational movement of the arm 9. While the arm 9 is rotationally moved, the door linkage 34 is rotationally moved with the arm 9.

The rotational movement of the door linkage 34 causes the shaft 32, which is in connection with the door linkage 34, to arcuately move as indicated by an arrow mark 80 (FIG. 6). During this movement of the shaft 33, the shaft 33, with which the cover 5 is provided, arcuately moves by being guided by the guiding groove 55*a*. Thus, the cover 5 slidingly moves in both upward and rearward (toward rear end of main assembly) while remaining in the same attitude as that in which it is when it is remaining closed. That is, the cover 5 slidingly moves with its horizontal portion 5*a* remaining horizontal. This sliding movement of the cover 5 exposes the opening Y. In other words, this embodiment of the present invention makes the cover 5 slidingly move into the area below the delivery tray 24 while keeping the cover 5 in the same attitude as that in which the cover 5 is when it is remaining closed; the cover 5 retreats from the area above the cartridge 3Y. Therefore, it does not occur that the cover 5 interferes with the mounting of cartridge 3Y into the tray 26, or the removal of the cartridge 3Y from the tray 26.

In this embodiment, the cover 5 slidingly moves while maintaining the same attitude as the attitude it has when it is remaining closed. Then, it enters the space below the delivery tray 24, as described above. Therefore, even though the cover 5 is moved into its open position each time the tray 26 is pulled out of the main assembly 100, the movement of the cover 5 is not conspicuous. In addition, in a case where the tray 26 is pulled out of the main assembly 100, it is likely for the cartridge(s) to be replaced. Thus, structuring the apparatus 200 so that the cover 5 is opened by the outward movement of the tray 26 improves the apparatus 200 in cartridge replacement efficiency.

Further, when the cartridge 3C, for example, in the apparatus 200 in this embodiment is replaced, the tray 26 has to be pulled out of the main assembly 100 only by the distance which is large enough to place the cartridge 3C below the opening Y. In other words, this embodiment makes it possible to reduce the distance by which the tray 26 has to be pulled out to replace the cartridges 3, making it possible to improve the apparatus 200 in the efficiency with which the cartridges 3 can be replaced. As the tray 26 is pulled out from its innermost position I to its outermost position O, the cover 5 is moved to its open position by the outward movement of the tray 26, as described above. The cover moving first means, that is, the means for moving the cover 5, to its open position has the projection 7, arm 9, shafts 32 and 33, door linkage 34, rotational shaft 36, spring 38, guiding plate 55, and guiding groove 55*a*. By the way, the structure of the means for moving the cover 5 does not need to be limited to the above described one. This subject will be described again later.

Further, as the cover 5 is moved, the flapper 35 rotationally moves by being pushed by the end portion of the cover 5.

The apparatus 200 in this embodiment is structured so that the cover 5 is opened through the above described steps. Therefore, it can provide an ample space for mounting or removing the cartridge(s) 3 even though the apparatus 200 is significantly smaller than any of conventional apparatus, in terms of the distance by which the tray 26 has to be pulled out to replace the cartridges 3. In other words, this embodiment of the present invention can reduce the space which the main assembly 100 occupies, without sacrificing the operability of the apparatus 200 in terms of the mounting or removal of the cartridges 3.

(Closing Operation)

Next, referring to FIG. 7, the movement of the cover 5, which occurs when the tray 26 is moved into the main assembly 100, will be described.

Figure 7:
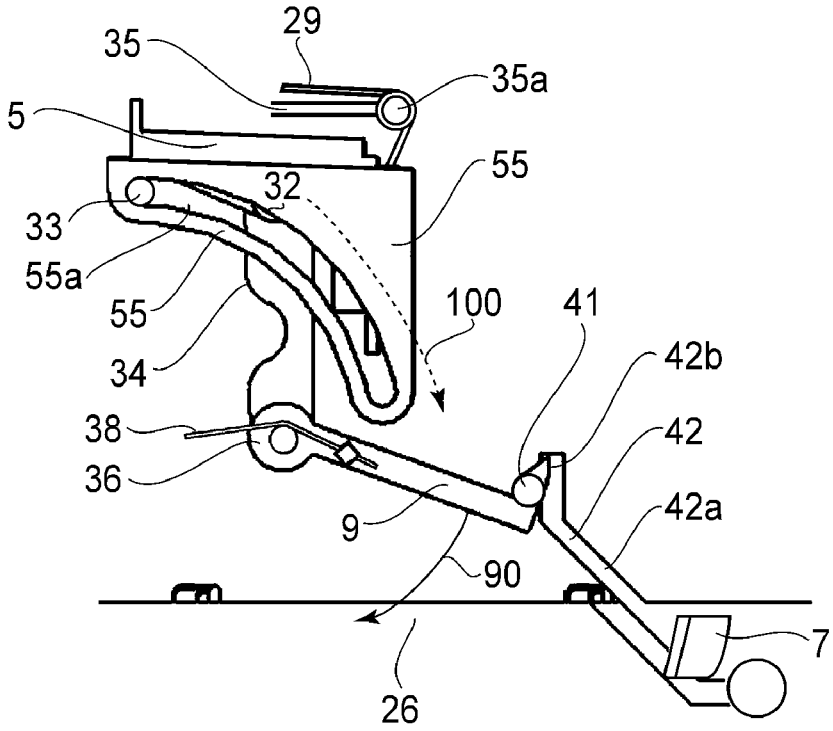
FIG. 7 is a drawing for describing the mechanism for causing the movement of the tray to move the covers, in the first preferred embodiment.

Referring to FIG. 7, the tip portion of the arm 9 is provided with a projection 41. A predetermined portion of the tray 26 is provided with a guide 42, which is enabled to engage with the projection 41. The guide 42 has a slanted surface by which the guide 42 engages with the projection 41. As a user pushes the tray 26 into the main assembly 100, the tip 42*b* of the guide 42 comes into contact with the projection 41. Then, as the tray 26 is pushed further inward, the arm 9 rotates in the clockwise direction (indicated by arrow mark 90 in FIG. 7) about the shaft 36, against the resiliency of the spring 38, while being guided by the guiding surface 42*a* of the guide 42. As the arm 9 rotationally moves, the door linkage 34 is rotationally moved by the movement of the arm 9. Thus, the shaft 32, which is in connection with the door linkage 34, arcuately moves as indicated by an arrow mark 100 (FIG. 7). As the shaft 32 arcuately moves, the shaft 33, with which the cover 5 is provided, is guided by the guiding groove 55*a*, being therefore arcuately moved. Thus, the cover 5 slidingly moves both downward and frontward (frontward of main assembly), while remaining in the same attitude as the attitude in which it is when it is open. In other words, the cover 5 is closed by the movement of the tray 26, which occurs when the tray 26 is pushed into the main assembly 100. Here, the means for closing the cover 5 by using the movement of the tray 26, which occurs when the tray 26 is pushed into the main assembly 100, is made up of the arm 9, projection 41, guide 42, door linkage 34, guiding groove 55*a*, and shaft 33.

Next, referring to FIG. 5, the movement of the rear cover 4, which occurs when the tray 26 is moved back into the main assembly 100, will be described.

The cover 4 is the cover for taking care of the sheet conveyance passage jam caused by the sheet 14. In order to take care of this problem, it is necessary for a user to put his or her hand through the opening X. Thus, the apparatus 200 is provided with a movement regulating member, which prevents the problem that the tray 26 unexpectedly moves to its inward position when the cover 4 is not closed. The operation for taking care of jam means the operation for removing the jammed sheet 14 in the sheet conveyance passage S.

Referring to FIG. 5, the lengthwise center portion of the arm 8 is provided with a projection 44, whereas the rear end portion of the tray 26 is provided with an arm movement controlling portion 45 (regulating member on main assembly side), which is enabled to engage with the projection 44. The arm movement controlling portion 45 is a part of the tray 26, and projects upward from the tray 26. If a user happens to attempt to push the tray 26 inward of the main assembly 100 without closing the cover 4, the arm movement controlling portion 45 comes into contact with the projection 44, preventing thereby the tray 26 from being pushed into the main assembly 100 when the cover 4 is open. That is, the projection 44 (tray movement regulating member on main assembly side) and the tray movement controlling portion 45 (tray movement regulating portion on supporting member side) are the portions for preventing the tray 26 in its outermost position O from being moved to its innermost position I when the cover 4 is open.

The surface 45*a* of the tray movement controlling portion 45, which comes into contact with the projection 45, arcuately protrudes in such a manner that when the cover 4 is open, the point of contact between the tray movement controlling portion 45 and projection 44 coincides with the axis of the rotational shaft 30 of the arm 8. Therefore, if an attempt is made to push the tray 26 into the main assembly 100 when the cover 4 is open, the tray movement controlling portion 45 comes into contact with the projection 44, being prevented from rotationally moving the arm 8; even if a greater amount of force is applied to the tray 26 to push the tray 26 into the main assembly 100, the force does not act in the direction to rotationally move the arm 8. Therefore, the tray 26 cannot be pushed further into the main assembly 100 to be stored in the main assembly 100. The image forming apparatus 200 in this embodiment has a second means for moving the cover 4 to its open position. More specifically, if the tray 26 is pulled out of its innermost position I to its outermost position O after the sensor 400 detected that the sheet conveyance passage S became jammed with the sheet 14, the second means for moving the cover 4 is made, by the movement of the tray 26, to move the cover 4 to its open position. The second means for moving the cover 4 is made up of the arm 8, rotational shaft 30, spring 31, arm stopper 39, projection 44. By the way, the structure of the second means for moving the cover 4 does not need to be limited to the above described one. The means may be structures as will be described later.

The apparatus 200 in this embodiment is structured so that unless a user manually closes the cover 4, the tray 26 cannot be moved back into the main assembly 100, preventing thereby a user from forgetting to take care of the jam. That is, the present invention improves an electrophotographic image forming apparatus in usability.

The cover 4 is always kept pressed by the resiliency of the spring 31 (elastic member) in the direction to be opened. Therefore, if the cover 4 is closed without moving the tray 26 back into the main assembly 100, the cover 4 automatically opens again. Thus, the apparatus 200 in this embodiment is provided with a locking means for temporarily keeping the cover 4 in its locked position if the cover 4 is manually closed while the tray 26 is remaining outside the main assembly 100.

Figure 8:
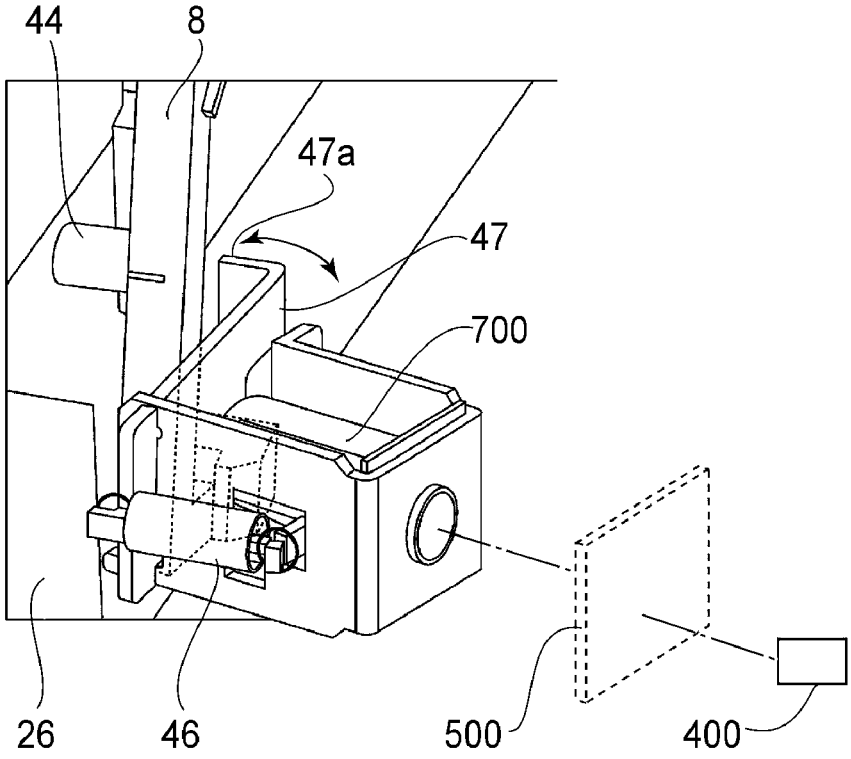
FIG. 8 is a drawing for describing the mechanism for causing the movement of the tray to move the covers, in the first preferred embodiment.

Referring to FIG. 8, the mechanism for temporarily locking the cover 4 is structured so that moving the cover 4 into its closed position in the main assembly 100 enables a user to slide the lever 47, which can be engaged with the arm 8, in the direction indicated by the arrow mark. The lever 47 is kept pressed by the resiliency of the compression spring 46 (elastic member) toward the arm 8. Further, the lever 47 has a tilted and tapered surface 47*a* which faces the arm 8.

If a user closes the cover 4 when the tray 26 is outside the main assembly 100, the arm 8 comes into contact with the slanted surface 47*a*. Then, as the user pushes the cover 4 further toward its closed position, the arm 8 pushes away the lever 47 against the resiliency of the spring 46. As the user moves the cover 4 in its closing direction by a preset amount, the arm 8 passes by the slanted surface 47*a*, allowing thereby the lever 47 to be pushed back into its initial position by the resiliency of the spring 46. Consequently, the arm 8 is locked by the lever 47, and therefore, the rear cover 4 is kept in its closed position.

As a user manually closes the cover 4, the contact between the projection 44 and tray movement controlling portion 45 disappears, making it possible for the tray 26 to be put back into the main assembly 100.

Referring to FIG. 5, the projection 6, which projects from the rear portion of the tray 26 has a tapered and slanted surface. Thus, as the tray 26 is moved inward of the main assembly 100 when it is outside the main assembly 100, the projection 6 comes into contact with the slanted surface 47*a* of the lever 47. Then, as the tray 26 is moved further inward of the main assembly 100, the projection 6 pushes away the lever 47 against the resiliency of the spring 46, and comes into contact with the arm 8. Consequently, the temporarily locked cover 4 is unlocked.

Even after the unlocking of the temporarily locked cover 4, the arm 8 remains controlled by the projection 6. Therefore, as the tray 26 is pulled out of the main assembly 100, the cover 4 is opened by the outward movement of the tray 26.

That is, in the case of the image forming apparatus 200 in this embodiment, as the tray 26 is pulled out of the main assembly 100, both the rear cover 4 and front cover 5 are opened by the movement of the tray 26, as described above. That is, the tray 26 opens the covers 4 and 5 as it is pulled out of the main assembly 100. Further, the tray 26 closes the cover 5 as it is pushed into the main assembly 100. By the way, the image forming apparatus 200 in this embodiment is not structured so that as the tray 26 is pushed into the main assembly 100, the cover 4 is closed by the movement of the tray 26. That is, the cover 4 has to be manually closed by a user. In addition, unless the cover 4 is in its closed position, the tray 26 cannot be pushed into the main assembly 100. This set up prevents the user from pushing the tray 26 into the main assembly 100 before the user removes the jammed sheet in the sheet conveyance passage S. Further, in the case of the image forming apparatus 200 in this embodiment, the operation for replenishing the main assembly 100 with the sheets 14, the operation for replacing the cartridge(s) 3, the operation for removing the jammed sheet 14, and the like operations, which are to be carried out by a user, can all be carried out from the front side of the main assembly 100. In other words, the present invention could improve an electrophotographic image forming apparatus in usability.

Further, the main assembly 100 is provided with the cover 5, which is on the front side of the main assembly 100 and is opened or closed by the movement of the tray 26. The provision of this cover 5 made it possible to reduce the distance by which the tray 26 has to be pulled out to replace the cartridge 3, without reducing the apparatus 200 in terms of the efficiency with which the cartridge 3 can be replaced. In other words, the present invention made it possible to reduce in size the space in which the main assembly 100 is to be set up for image formation.

Further, the apparatus 200 is structured so that when the cover 4 is open, the tray 26 cannot be moved back into the main assembly 100. Therefore, it is easy to take care of the sheet jam in the main assembly 100.

Further, in this embodiment, the contact between the projection 44 of the tray 26, and the arm 8, is used as the structural arrangement for causing the rear cover 4 to be opened by the movement of the tray 26 when the tray 26 is pulled out of the main assembly 100. Further, the contact is also used as the structural arrangement for causing the front cover 5 to open or closed by the movement of the tray 26 when the tray 26 is pulled out of, or pushed into, the main assembly 100. The structural arrangement for the means (first and second means) for moving the doors 5 and 4 with the use of the movement of the tray 26 does not need to be limited to the above described one. For example, the means may be made up of a partially toothed gear, and a pinion rack gear. However, the above described structural arrangement is simpler, and smoother in operation.

Embodiment 2

Next, referring to FIGS. 9 and 10, the image forming apparatus in the second preferred embodiment of the present invention will be described. The apparatus in this embodiment is the same in basic structure as the apparatus in the preceding embodiment described above. Therefore, the portions of the description of this embodiment, which are the same as those of the counterparts in the preceding embodiment, will not be given here to avoid repetitions. In other words, only the structural features of the image forming apparatus in this embodiment, which characterize this embodiment, will be described. The portions of the image forming apparatus in this embodiment, which are the same in function as the counterparts in the first preferred embodiment, will be given the same referential codes as those given to the counterparts.

In the first preferred embodiment, toner images (developer images) were transferred (secondary transfer) onto a sheet of recording medium (sheet 14) with the use of the intermediary transfer belt. In this embodiment, however, a sheet of recording medium is conveyed with the use of a transfer medium conveyance belt, and toner images are directly transferred onto the sheet of recording medium on the belt, from the photosensitive drum 1.

Figure 9:
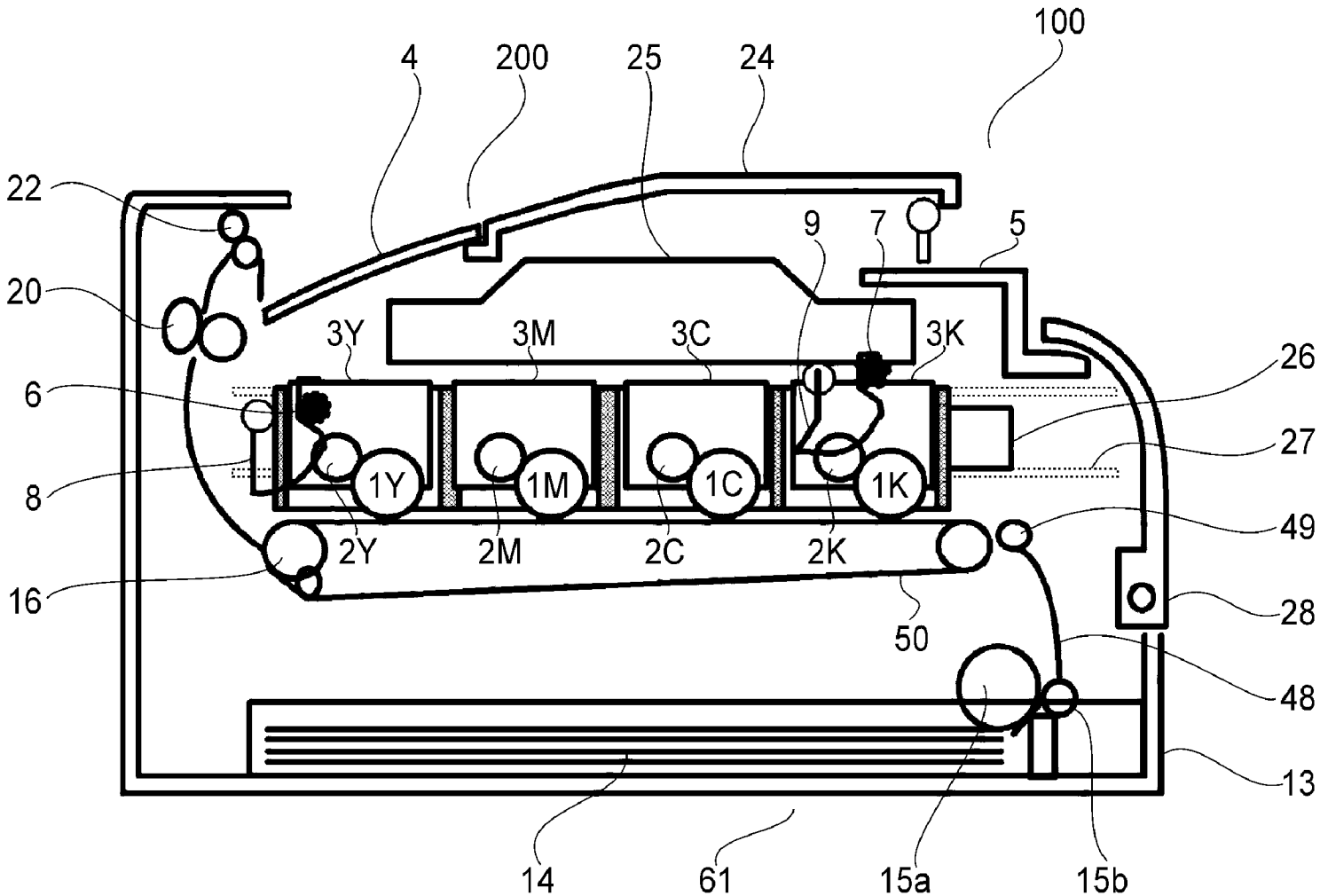
FIG. 9 is a drawing for describing the image forming apparatus in the second preferred embodiment of the present invention.

FIG. 9 is a schematic vertical sectional view of the image forming apparatus 200 in the second preferred embodiment of the present invention. After being fed into the main assembly 100 by a pair of sheet feeder rollers 5*a* and 5*b*, the sheet 14 is guided by a guide 48 to an adhesion roller 49 and a transfer medium conveyer belt 50. The belt 50 conveys the sheet 14 by being circularly moved by a driving roller 16 in the counter-clockwise direction of the drawing. After the formation of toner images on the photosensitive drums 1, the toner images are transferred onto the sheet 14 on the belt 50.

After the transfer of the toner images onto the sheet 14, the sheet 14 is sent to a fixing apparatus 20, in which the toner images on the sheet 14 are fixed to the sheet 14 by being subjected to head and pressure. Consequently, a permanent full-color toner image is effected on the sheet 14. After the fixation of the toner images, the sheet 14 is discharged into a delivery tray 24 by a pair of discharge rollers 22.

Figure 10:
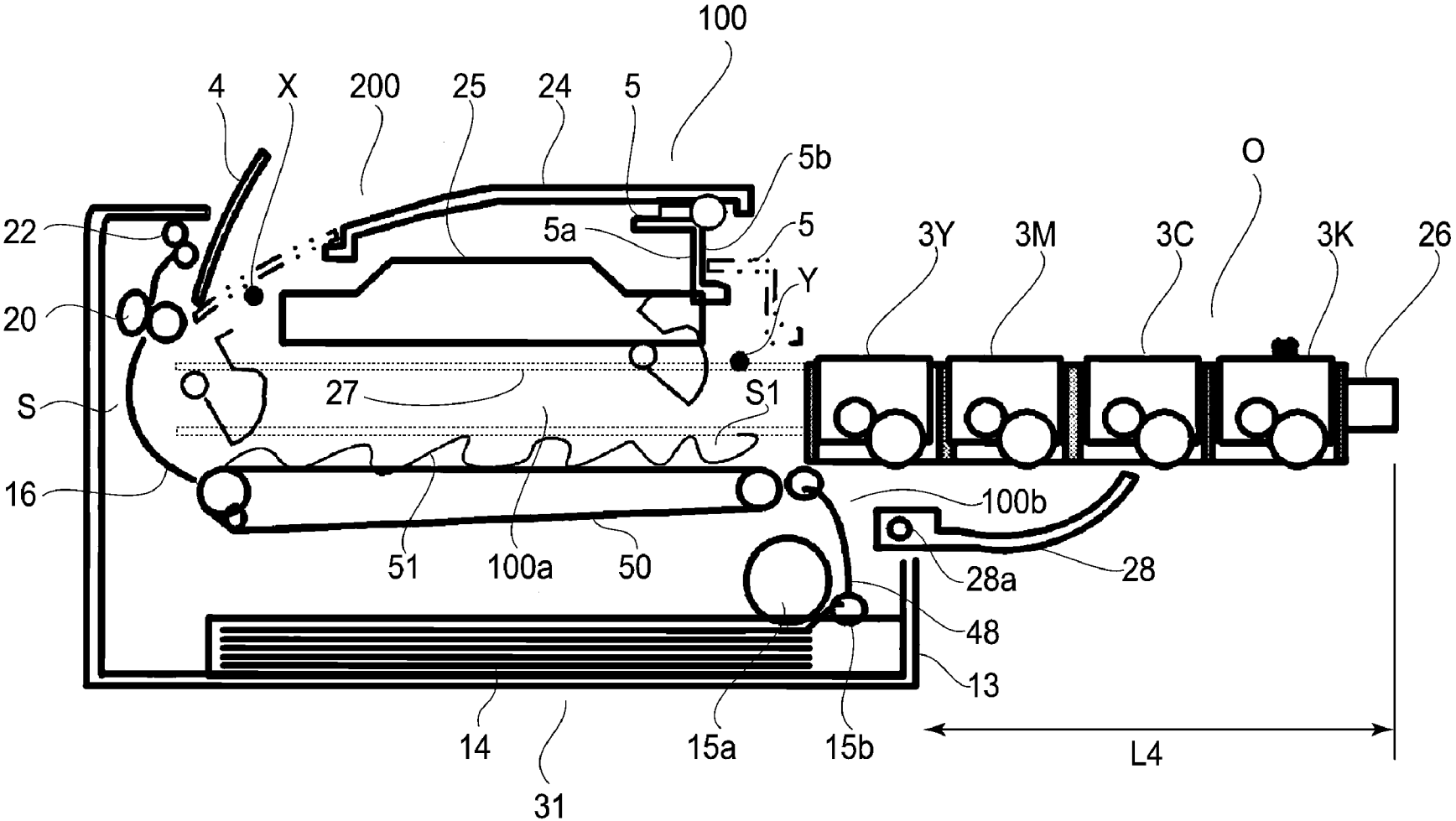
FIG. 10 is a drawing for describing the image forming apparatus in the second preferred embodiment.

FIG. 10 is a schematic sectional view of the image forming apparatus in this preferred embodiment when the tray 26 is in its outward position to take care of a paper jam. In the case of the image forming apparatus in this embodiment, which is structured to use the belt 50, the sheet 14 is conveyed through the main assembly 100 by the belt 50. Therefore, it is sometimes necessary to take care of a sheet 51 (FIG. 10), that is, a sheet 14 which has stuck to the surface of the belt 50.

As the tray 26 is pulled out of the main assembly 100, the rear cover 4 and front cover 5 are opened by the movement of the tray 26 by a mechanical linkage, such as the one in the first preferred embodiment described above, which connects the tray 26 to the front door 4 and rear door 5.

Also in this embodiment, pulling the tray 26 out of the main assembly 100 by a distance of L1 makes it possible to mount or remove the cartridge 3, and also, to take care of the recording medium Jam which has occurred in the rear portion the main assembly 100 (rear portion of the sheet conveyance passage S), as it does in the first preferred embodiment.

In the case of the image forming apparatus in this embodiment, the sheet of recording medium, which has stuck to the belt 50, has to be taken care of. Therefore, the tray 26 has to be pulled out by a distance of L4 (FIG. 10), which is greater than the distance L1 (FIG. 2) mentioned in the first preferred embodiment, so that the opening Y, which is large enough for the belt 50 to be accessed, can be created.

In this embodiment, the opening Y is created by opening the front cover 5 which keeps the tray 26 and sheet conveyance passage S covered. A sheet conveyance passage S1 (bottom portion) is the sheet conveyance passage, through which the sheet 14 is conveyed by the circularly movement of the belt 50. Therefore, the sheet 51 which has stuck to the top portion of the belt 50 loop can be removed by an operator through the opening Y and space 100*a* of the main assembly 100. That is, the present invention can reduce the distance L4 by which the tray 26 has to be pulled out to take care of the jammed sheet 14, without negative effects upon the easiness with which the jammed sheet 14 can be taken care of.

In this preferred embodiment, the main assembly 100 has the sheet conveying passage S1 under the innermost position I for the tray 26. The opening Y (second opening) is for taking the cartridge 3 supported by the tray 26, out of the tray 26, and for placing the cartridge 3 in the tray 26 to support the cartridge 3 by the tray 26. It is also for removing the sheet 51 (jammed sheet 14) in the sheet conveyance passage S1.

This embodiment makes it possible for a user to remove the jammed sheet 51 by putting his or her hand in the main assembly 100. Further, it makes it possible for a user to mount the cartridge 3Y into, removed from, the most upstream cartridge space of the tray 26 through the opening Y, when the tray 26 is in its outermost position O. That is, this embodiment makes it possible to use the opening Y for both purposes described above. Incidentally, the position of the tray 26, which is shown in FIG. 10, is the outermost tray position to which the tray 26 was pulled out to make it possible for the jammed sheet 51 to be removed through the opening Y. However, if the tray 26 is to be pulled out of the main assembly 100 just for mounting the cartridge 3 into the tray 26, or removing the cartridge 3 from the tray 26, the tray 26 does not need to be pulled out to the position shown in FIG. 10. In other words, normally, the tray 26 is unlikely to pulled out as far as the position shown in FIG. 10.

In each of the preferred embodiments described above, the front cover 5 (first cover) is made to expose or cover the opening Y (second opening), by the movement of the tray 26 (cartridge supporting member). Therefore, the cartridges 3 are exposed even though the distance by which the tray 26 in this embodiment is pulled out is not as large as the distance by which the tray 26 of a conventional electrophotographic image forming apparatus has to be pulled out to expose its cartridges. That is, the present invention makes it possible to replace the cartridges 3 even though the distance (length) by which the tray 26 is pulled out of the main assembly 100 is less than the full length of the tray 26. In other words, the present invention can make it possible to easily mount or remove the cartridges 3, while reducing the amount of space necessary to set up the apparatus 200 for operation.

Further, the front cover 5 is made to expose or close the opening Y, by the movement of the tray 26. Thus, even though the distance by which the tray 26 has to be moved to mount or remove the cartridges 3 is significantly less than the distance by which the tray (26) of a conventional image forming apparatus has to be moved for the mounting or removal of the cartridges 3, the tray 26 is fully exposed for the cartridges 3 to be easily replaced. In other words, the present invention makes it easier to mount or remove the cartridges 3 while reducing the mount of space necessary to set up the apparatus 200 for operation.

Further, the present invention can make it easier to mount or remove the cartridges 3 while reducing the amount of operational space necessary for the main assembly 100. Also, the present invention makes it easier to remove the stuck recording medium in the main assembly 100 while reducing the amount of operational space necessary for the main assembly 100. Further, the present invention can make it possible to open the covers 4 and 5 with the use of the movement of the tray 26. Further, each of the preferred embodiments of the present invention described above makes it possible to easily remove the jammed sheet 14 in the sheet conveyance passage S which is in the rear side of the innermost position I of the tray 26. Further, the present invention makes it possible to easily remove the sheet 51 (recording medium) stuck in the sheet conveyance passage S1 which is under the innermost position I of the tray 26.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 249592/2008 and 212997/2009 filed Sep. 29, 2008 and Sep. 15, 2009, respectively, which are hereby incorporated by reference.

What is claimed is:

1. An electrophotographic image forming apparatus for forming an image on a recording material in the state that a cartridge is detachably mounted to a main assembly of said electrophotographic image forming apparatus, said electrophotographic image forming apparatus comprising:

a cartridge supporting member movable between an inside position in said main assembly of said apparatus and an outside position outside said main assembly of said apparatus when a cartridge is mountable thereto and dismountable from said cartridge supporting member;

a first opening through which said cartridge supporting member passes between the inside position and the outside position;

a first openable member for openably closing said first opening;

a second opening continuing from said first opening and provided above said first opening, said second opening being effective to permit the cartridge to be removed from said cartridge supporting member in the state that said cartridge supporting member takes the outside position and being effective to permit said cartridge supporting member to support said cartridge;

a second openable member for openably closing said second opening, said second openable member being effective to prevent external light from entering said main assembly of said apparatus when said second openable member closes said second opening; and interrelating means for moving said second openable member to the open position in interrelation with movement of said cartridge supporting member from the inside position to the outside position.

2. An apparatus according to claim 1, wherein said second openable member is slidable, when maintaining its attitude, between a closing position for closing said second opening and an open position for opening said second opening.

3. An apparatus according to claim 1 or 2, further comprising a third opening for permitting removal of recording material jammed in a rear side feeding path, the rear side feeding path (i) provided at an upper portion of said main assembly of said apparatus in a rear side of said cartridge supporting member placed in the inside position, and (ii) for feeding the recording material;

a third openable member for openably closing said third opening for preventing external light from entering said main assembly of said apparatus when said third opening is closed by said third openable member; and second interrelating means for moving said third openable member to the open position in interrelation with the movement of said cartridge supporting member from the inside position to the outside position when jamming of the recording material in the rear side feeding path is detected.

4. An apparatus according to claim 3, wherein said main assembly of said apparatus includes a lower feeding path, provided below said cartridge supporting member, for feeding the recording material, wherein said second opening is effective to permit the cartridge to be removed from said cartridge supporting member, to permit said cartridge to be supported by said cartridge supporting member, and to permit removal of recording material jammed in said lower feeding path.

5. An electrophotographic image forming apparatus for forming an image on a recording material in the state that a cartridge is detachably mounted to a main assembly of said electrophotographic image forming apparatus, said electrophotographic image forming apparatus comprising:

a cartridge supporting member movable between an inside position in said main assembly of said apparatus and an outside position outside said main assembly of said apparatus when a cartridge is mountable thereto and dismountable from said cartridge supporting member;

a first opening through which said cartridge supporting member passes between the inside position and the outside position;

a first openable member for openably closing said first opening;

a second opening for permitting removal of recording material jammed in a rear side feeding path, said rear side feeding path (i) provided at an upper portion of said main assembly of said apparatus in a rear side of said cartridge supporting member placed in the inside position, and (ii) for feeding the recording material;

a second openable member for openably closing said second opening for preventing external light reflected by said cartridge from entering said main assembly of said apparatus when said second opening is closed by said second openable member; and interrelating means for moving said second openable member to the open position in interrelation with the movement of said cartridge supporting member from the inside position to the outside position when jamming of the recording material in said rear side feeding path is detected.

6. An apparatus according to claim 5, further comprising a regulating member for regulating movement of said cartridge supporting member to the inside position from the outside position when said second openable member takes the open position.

* * * * *